US007150799B2

(12) United States Patent
Zhao et al.

(10) Patent No.: US 7,150,799 B2
(45) Date of Patent: Dec. 19, 2006

(54) WELD NUGGET INOCULATION

(75) Inventors: Xihua Zhao, Jilin (CN); Lei Zhao, Jilin (CN); Pei-Chung Wang, Troy, MI (US)

(73) Assignees: General Motors Corporation, Detroit, MI (US); Jilin University, Changchun (CN)

( * ) Notice: Subject to any disclaimer, the term of this patent is extended or adjusted under 35 U.S.C. 154(b) by 343 days.

(21) Appl. No.: 10/715,892

(22) Filed: Nov. 18, 2003

(65) Prior Publication Data

US 2005/0103406 A1 May 19, 2005

(51) Int. Cl.
*C22F 1/04* (2006.01)

(52) U.S. Cl. ..... 148/535; 228/194; 228/248.1

(58) Field of Classification Search ..... 148/535; 228/194, 244, 248.1
See application file for complete search history.

(56) References Cited

U.S. PATENT DOCUMENTS

| | | | | |
|---|---|---|---|---|
| 4,038,514 | A * | 7/1977 | Ashton | 219/126 |
| 4,943,492 | A * | 7/1990 | Holroyd et al. | 428/654 |
| 6,335,512 | B1 | 1/2002 | Warren et al. | 219/137 |
| 6,410,165 | B1 | 6/2002 | Warren et al. | 428/680 |
| 6,779,707 | B1 * | 8/2004 | Dracup et al. | 228/112.1 |

* cited by examiner

*Primary Examiner*—George Wyszomierski
(74) *Attorney, Agent, or Firm*—Kathryn A. Marra

(57) ABSTRACT

A weld nugget between aluminum alloy parts is inoculated with a material in order to refine the grain structure of the weld and thereby improve its mechanical strength. The inoculate may be a Ti or Na based compound in the form of a paste, powder or film, which is applied to the sheets before welding. The inoculation promotes nucleation of desirable equiaxed grain within the molten weld nugget as the weld cools and solidifies.

18 Claims, 3 Drawing Sheets

| The sorts of inoculation | The specimens No. | Welding parameters | | | | | | Mechanical properties | | | | | |
|---|---|---|---|---|---|---|---|---|---|---|---|---|---|
| | | Welding current Iw/kA | | | Welding time tw/s | Welding force $F_1$/N | Forging force $F_2$/N | Tensile shear load $F_T$/N | Tensile shear load range (N) | Average tensile shear load (N) | The bias (%) | Improvement (%) | Fracture type |
| NO | 501 | 18.7 | 18.7 ~ 18.8 | 18.74 | 0.14 | 3000 | 7000 | 2822 | 2822 ~ 2920 | 2877.8 | -1.94 ~ +1.47 | | tore |
| | 502 | 18.7 | | | | | | 2906 | | | | | |
| | 503 | 18.7 | | | | | | 2920 | | | | | |
| | 504 | 18.8 | | | | | | 2910 | | | | | |
| | 505 | 18.8 | | | | | | 2831 | | | | | |
| Al-Ti5B1RE1 | 511 | 20.3 | 20.3 ~ 20.4 | 20.34 | 0.18 | 3000 | 7000 | 3250 | 3250 ~ 3597 | 3451.8 | -5.85 ~ +6.56 | 19.95 | |
| | 512 | 20.3 | | | | | | 3597 | | | | | |
| | 513 | 20.4 | | | | | | 3508 | | | | | |
| | 514 | 20.4 | | | | | | 3452 | | | | | |
| Al-Ti3C 0.15 | 521 | 20.3 | 20.3 ~ 20.7 | 20.5 | 0.18 | 3000 | 7000 | 3015 | 2985 ~ 3547 | 3254.5 | -7.36 ~ +8.99 | 13.09 | |
| | 522 | 20.5 | | | | | | 3471 | | | | | |
| | 523 | 20.5 | | | | | | 3547 | | | | | |
| | 524 | 20.7 | | | | | | 2985 | | | | | |

| Dead load □ N □ | Max dynamic load (N) | Cicles without inoculations | Cicles with inoculations | Improvement (%) |
|---|---|---|---|---|
| 1370 | 920 | $2.25 \times 10^3$ | $2.9 \times 10^3$ | 28.9 |
| 1370 | 745 | $6.5 \times 10^3$ | $1.7 \times 10^4$ | 161.5 |
| 1370 | 510 | $3.19 \times 10^4$ | $8.7 \times 10^4$ | 172.7 |
| 1370 | 385 | $1.29 \times 10^5$ | $0.99 \times 10^6$, not break | —— |

Figure 8

| The sorts of inoculation | The specimens No. | Welding parameters | | | | | | Mechanical properties | | | | | |
|---|---|---|---|---|---|---|---|---|---|---|---|---|---|
| | | Welding current Iw/kA | | | Welding time tw/s | Welding force $F_1$/N | Forging force $F_2$/N | Tensile shear load $F_T$/N | Tensile shear load range (N) | Average tensile shear load (N) | The bias (%) | Improvement (%) | Fracture type |
| NO | 601 | 20.9 | 20.9 ~ 21.0 | 20.94 | 0.22 | 2100 | 5600 | 2255 | 1471 ~ 2255 | 1840.2 | -20.06 ~ +22.54 | | ripped |
| | 602 | 20.9 | | | | | | 1471 | | | | | |
| | 603 | 20.9 | | | | | | 1635 | | | | | |
| | 604 | 21.0 | | | | | | 2169 | | | | | |
| | 605 | 21.0 | | | | | | 1671 | | | | | |
| AlTi5B1RE1 | 611 | 23.0 | 23.0 ~ 23.1 | 23.05 | 0.22 | 2100 | 5600 | 2673 | 2335 ~ 2673 | 2496 | -6.45 ~ +7.09 | 35.64 | |
| | 612 | 23.1 | | | | | | 2335 | | | | | |
| | 613 | 23.1 | | | | | | 2344 | | | | | |
| | 614 | 23.1 | | | | | | 2632 | | | | | |
| AlTi3C 0.15 | 621 | 23.1 | 23.1 ~ 23.5 | 23.25 | 0.22 | 2100 | 5600 | 2627 | 2655 ~ 2813 | 2730 | -2.75 ~ +3.0 | 49.98 | |
| | 622 | 23.2 | | | | | | 2813 | | | | | |
| | 623 | 23.2 | | | | | | 2665 | | | | | |
| | 624 | 23.5 | | | | | | 2776 | | | | | |
| AlSr10 | 631 | 23.1 | 23.1 | 23.1 | 0.22 | 2100 | 5600 | 3008 | 2464 ~ 3008 | 2856.8 | -13.75 ~ +5.29 | 55.24 | |
| | 632 | 23.1 | | | | | | 2464 | | | | | |
| | 633 | 23.1 | | | | | | 2972 | | | | | tore |
| | 634 | 23.1 | | | | | | 2983 | | | | | |

Figure 9

| Dead load □ N □ | Max dynamic load (N) | Cicles without inoculations | Cicles with inoculations | Improvement (%) |
|---|---|---|---|---|
| 1370 | 920 | Break immediately after start | $1.75 \times 10^3$ | —— |
| 1370 | 745 | $1.35 \times 10^3$ | $3.9 \times 10^4$ | 2788.9 |
| 1370 | 510 | $1.215 \times 10^4$ | $1.725 \times 10^5$ | 1319.8 |
| 1370 | 385 | $2.67 \times 10^5$ | $3.6 \times 10^5$ | 34.8 |
| 1370 | 270 | $4.05 \times 10^5$ | $0.9 \times 10^6$, not break | —— |

Figure 10

WELD NUGGET INOCULATION

FIELD OF THE INVENTION

The present invention broadly relates to techniques for improving the mechanical strength of metal welds, and deals more particularly with a method of inoculating welds in aluminum alloys in order to refine the weld grain structure.

BACKGROUND OF THE INVENTION

Aluminum alloys are frequently used as structural components in vehicle applications because of their high strength-to-weight ratio, and ease of formability. Aluminum alloy components, such as sheets used to form vehicle body panels are normally joined together by metal fusion processes, such as conventional resistance spot welding. Because vehicle applications impose cyclic stresses on the body components over a long period of time, it is important that the aluminum alloy welds possess adequate mechanical strength and resistance to fatigue.

In order to form resistance type spot welds between sheets of an aluminum alloy, the sheets are clamped together under pressure between a pair of welding electrodes, typically copper, and an electrical current is passed between the electrodes so as to flow through an area or "spot" on the sheets. This current flow heats the aluminum alloy material at the spot to its melting temperature, producing a molten weld nugget in which metal from the two sheets migrate toward each other to form a fusion weld when the molten nugget has cooled and solidified. The solidification process results from nucleation and growth of a new phase (a solid) at an advancing solid/liquid interface within the weld nugget. The solid phase within a molten weld nugget generally initiates by epitaxial growth from the surfaces of the material being welded, and proceeds by competitive growth toward the centerline of the weld. That is, grains with their easy growth direction oriented most preferentially along the heat flow direction gradient, tend to crowd out those grains whose easy growth directions are not as suitably oriented. The grain structure of the resulting weld is determined by the type of nucleation and growth of the solid phase. As the weld nugget cools, the solidification that begins at the walls of the substrate result the formation of grains that grow against the heat flux; these grains are known as columnar grains. Eventually, and depending upon the solidification conditions, equiaxed grains form in the central region the weld nugget. The columnar grain structures, i.e. structures in which the grains tend to be elongate and run parallel to each other, result in a weld that possesses less mechanical strength compared to a weld having an equiaxed grain structure where the grains are uniform in size and are arranged in a random orientation. Furthermore, the mechanical strength of the weld would degrade even more if the columnar grain structure is in the proximity of the high stress regions formed at the intersection of the weld nugget and the opening of the sheets. A solidified weld normally possesses both columnar and equiaxed grains, with the equiaxed grains being disposed in the center of the weld and surrounded by an outer boundary layer of columnar grains. In order to increase the mechanical strength of the weld as well as its resistance to fatigue, it would be desirable to maximize the volume of equiaxed grains, compared to the volume of the columnar grains. The present invention is directed toward achieving this objective.

SUMMARY OF THE INVENTION

According to one aspect of the invention, a method is provided for producing a weld between two aluminum alloy workpieces, comprising pressing the workpieces into contact with each other, producing a molten weld nugget at a spot between the workpieces, and promoting the formation of equiaxed grain structure within the weld nugget by inoculating the weld with particles of a material on which equiaxed grain may grow as the nugget cools and solidifies. The material used to inoculate the weld preferably contains at least Ti or Na. Ti may be introduced in alloy form, and Na can be any of several Na based compounds. The inoculating material may be introduced as a paste, a powder or a film applied to one or both of the workpiece surfaces to be welded prior to initiating the weld.

According to another aspect of the invention, a spot weld between two sheets of aluminum alloy is formed by pressing the sheets into contact with each other, producing a molten weld nugget at a spot between facing surfaces of the sheets, allowing the molten weld nugget to cool and thereby solidify, and promoting the formation of equiaxed grain structure with the nugget by introducing particles of a material into the molten nugget on which the equiaxed grain may grow as the molten nugget cools and solidifies. With the inoculating material having been applied to at least one of the surfaces to be welded, application of an electrical current through the workpieces melts contacting surface areas of the workpieces, causing a molten weld nugget to be formed. The introduction of the inoculating material into the nugget encourages nucleation of the finer, equiaxed grains as the nugget solidifies.

A significant advantage of the invention resides in its ability to not only increase the strength of an aluminum alloy weld, but also improve the consistency of weld quality by introducing a relatively inexpensive inoculant to the weld nugget.

Another advantage of the invention is conventional resistance welding equipment may be used to practice the inventive method without increasing weld cycle time. Also, the inventive method is that the inoculant material applied to the workpiece surfaces to be welded may be in any of a variety of readily available states such as powders, tapes, or preformed films.

These and other advantages and features of the invention will be made clear or will become apparent during the course of the following description of a preferred embodiment of the present invention.

BRIEF DESCRIPTION OF THE DRAWING

In the drawings which form an integral part of the specification and are to be read in conjunction therewith, and in which like reference numerals are employed to designate identical components in the various views:

FIG. 8 is a table showing the results of fatigue tests performed on welds of AA5182-O type aluminum alloy, with and without inoculation;

FIG. 9 is a table similar to FIG. 7 but showing test results for welds performed on AA6111-T4 aluminum alloy; and, FIG. 10 is a table showing test results similar to FIG. 8, but for welds performed on AA6111-T4 type aluminum alloy.

DETAILED DESCRIPTION OF THE INVENTION

Figure 1:
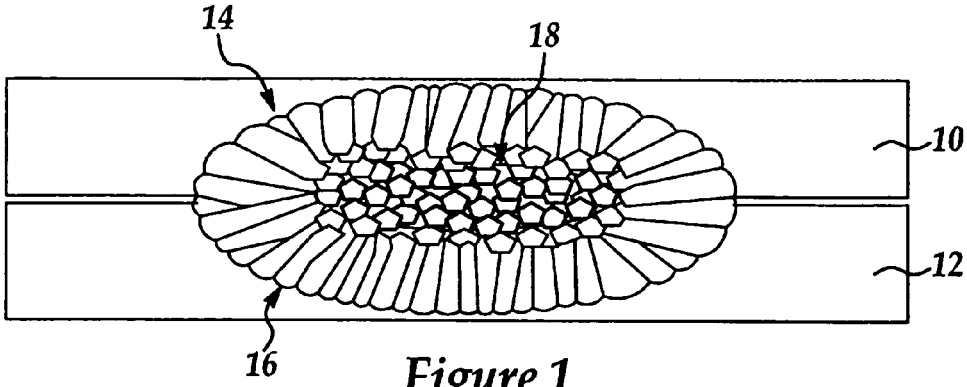
Figure 1 Prior Art
FIG. 1 is a fragmentary, cross sectional view of a weld between two sheets of aluminum alloy, made in accordance with a prior art welding method.
Figure 2:
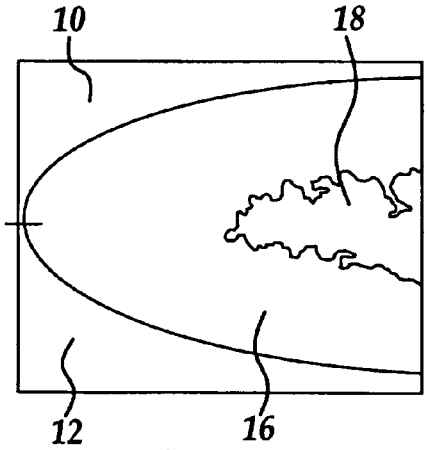
Figure 2 Prior Art
FIG. 2 is an enlarged view of one side of the weld shown in FIG. 1.
Figure 3:
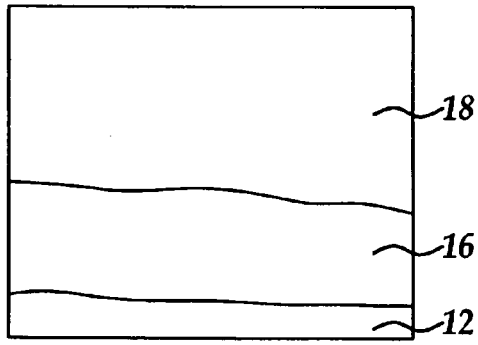
Figure 3 Prior Art
FIG. 3 is a fragmentary, enlarged view of a portion of the weld shown in FIG. 2, depicting the boundaries between differing grain structures.

Referring first to FIGS. 1–3, the present invention involves a fusion bond such as a weld 14 between two workpieces formed of aluminum alloy, herein shown as two sheets 10, 12. The weld 14 is commonly referred to as a spot weld that may be produced using conventional resistance welding equipment well-known in the art. Such equipment typically includes a power supply, and a pair of electrodes between which the sheets 10, 12 are clamped with a predetermined force. With the sheets 10, 12 in face-to-face contact under pressure, the power supply delivers an electrical current to the electrodes which flows through the facing, contacting surfaces of the sheets 10, 12 to produce a molten weld nugget. This weld nugget solidifies and cools to form a weld 14 which ideally possesses a mechanical strength approaching that of the aluminum alloy sheet material itself.

As weld nugget 14 cools, the molten aluminum alloy crystallizes as it changes state from a liquid to a solid. During the cooling process, crystallization of the outer boundary layers occurs first, and solidification proceeds inwardly toward the center of the weld 14 until the weld has completely crystallized. Crystallization of an outer boundary layer 16 in the weld nugget 14 results in a columnar grain structure in which the individual grains tend to be elongate with their longitudinal axes extending parallel to each other and oriented in the direction of the heat flow. The outer boundary 16 transitions into a central area 18 where the grain structure is equiaxed, i.e. the individual grains have equal dimensions, rather than being elongate, and have their axes randomly oriented relative to each other. As will be later discussed, the equiaxed grain structure of the central area 18 tends to provide the weld 14 with superior mechanical strength and fatigue resistance compared to a weld 14 where columnar grain structure are predominate within the weld nugget 14.

Figure 4:
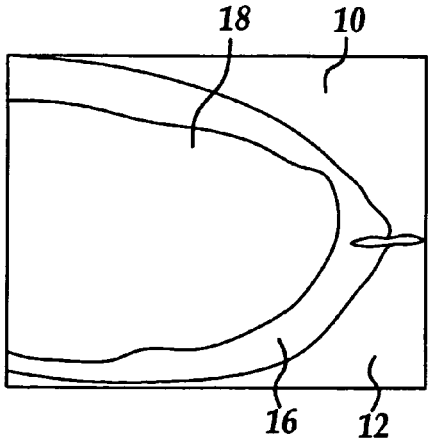
FIG. 4 is a view similar to FIG. 2 but showing the improved grain structure resulting from a weld performed in accordance with the method of the present invention.
Figure 5:
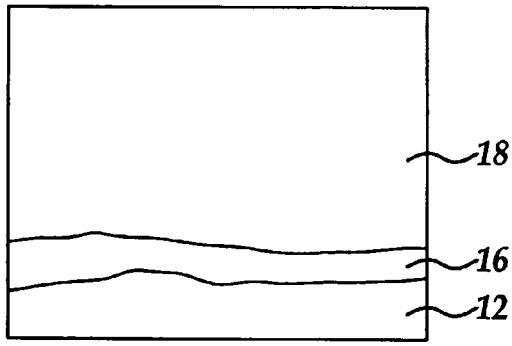
FIG. 5 is a fragmentary, enlarged view of a portion of the weld shown in FIG. 4, better depicting the boundaries of differing grain structure in the weld.

In accordance with the present invention, it has been found that the strength of a weld formed between aluminum alloy workpieces can be improved by inoculating the molten weld nugget with certain materials which tend to be particularly effective in promoting the nucleation of equiaxed grains as the nugget solidifies. FIGS. 4 and 5 of the accompanying drawings depict a spot weld between two sheets of AA5182-O type aluminum alloy sheets in which the weld nugget has been inoculated with the compound Al–Ti–B. It can readily seen from FIGS. 4 and 5 tat to volume of equiaxed grain 18 is substantially broader, and the area 16 of columnar grain is substantially reduced compared to the weld 14 shown in FIG. 1, The inoculant should include Ti or a Ti compound, or alternatively an Na or Na based compound. Examples of Ti compounds yielding the desired results include: Al+Ti; Al+Ti+C; Ti–B; Al+Ti–B; Al–Ti–B; Al–Ti–B–Re; and,Al–Ti–C.

Suitable sodium based compounds may include, for example:

The inoculant is applied to one or both if the facing surfaces of the workpieces to be welded. The inoculant may be in the form of a liquid or paste that is sprayed or brushed onto the workpiece surface, or the inoculant may be incorporated into a carrier formed into a film or foil which is interposed between the workpiece surfaces before they are clamped and welded. Testing had shown that in welding AA 5182-O aluminum alloys, an inoculant material comprising $AlTi_4BRe$ provides superior results. In welding AA 6111-T4 aluminum alloy) an inoculant comprising $AlTi_3C_{0.15}$ was found to provide satisfactory results.

Figures 6, 7:
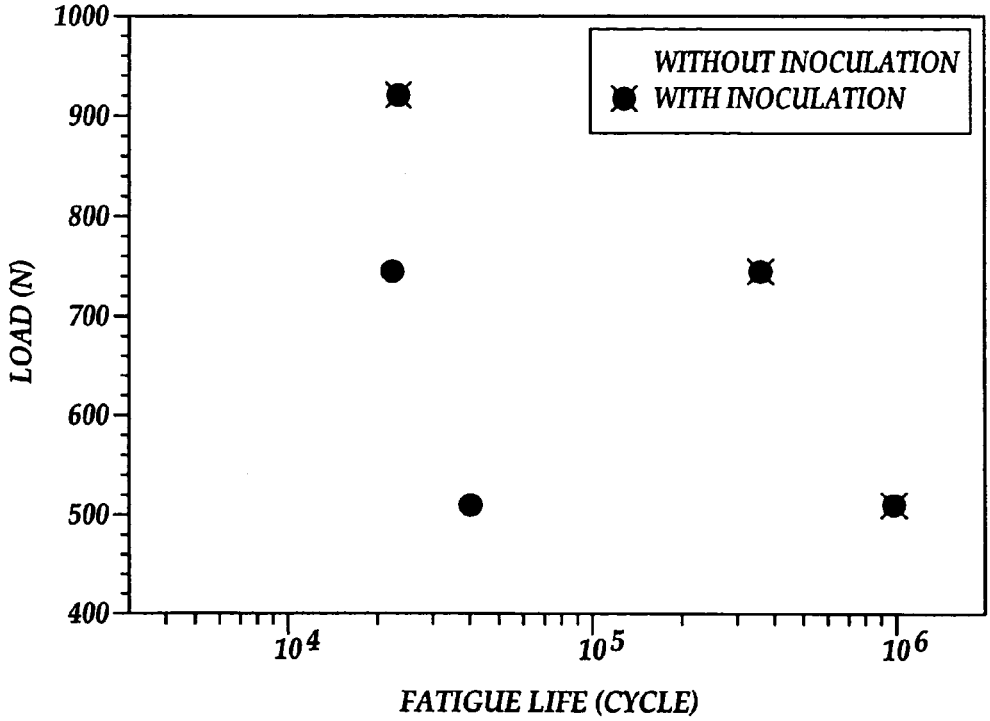
FIG. 6 is a plot of fatigue test results, comparing prior art welds of AA2024-T4 type aluminum alloy, and welds formed according to the inventive method employing weld nugget inoculation.
FIG. 7 is a table of test results showing the mechanical properties of welds of AA5182-O type aluminum alloy formed with and without inoculation.

A series of tests were performed to compare the properties of welds produced with and without inoculation according to the inventive method. FIG. 7 displays the results for spot welds between two sheets of AA 5182-0 aluminum alloy. The test results are displayed for welds subjected to two inoculants, and welds in which no inoculants were used. These test results clearly show that the mechanical properties of the inoculated welds were superior to those which did not receive inoculants. FIG. 8 depicts a table showing the results of fatigue tests carried out on the welds represented by test data in FIG. 7. As can be seen from the data in FIG. 8, the welds treated by inoculation withstood a greater number of fatigue cycles before breaking, compared to welds lacking inoculation.

A further set of tests to determine the mechanical properties of welds with and without inoculations were performed using two sheets of AA 6111-T4 as the workpieces being welded. The results of these tests are represented in the table of data shown in FIG. 9 which clearly show that the mechanical properties of inoculated welds according to the method of the present invention are markedly superior to those welds not having inoculation. FIG. 10 is a table showing the results of fatigue tests carried out on welds with and without inoculation preformed on AA 6111-T4 aluminum alloy workpieces. Again, it can be seen from FIG. 10 that welds provided with inoculation in accordance with the present invention exhibited superior fatigue resistance compared to welds without inoculation.

Further testing has confirmed that welds inoculated with the materials previously described exhibit improved mechanical strength and fatigue resistance for a wide variety of aluminum alloys including, for example, AA2024-T4, AA2024-T42, AA5154-0 and AA6061-T42. Fatigue tests were also performed on AA2024-T4 aluminum alloys, using welds with and without the invented inoculation. The results of these tests, depicted in the plot shown in FIG. 6 clearly show that welds possessing inoculation in accordance with the present invention exhibit markedly superior resistance to fatigue stress, compared to welds not provided with inoculation.

From the foregoing, it may be appreciated that the weld nugget inoculation described above not only provides advantages over the prior welding methods, but does so in a particularly effective and economical manner. It is recognized, of course, that those skilled in the art may make various modifications or additions chosen to illustrate the invention without departing from the spirit or scope of the present contribution to the art. Accordingly, it is to be understood that the protection sought and to be afforded hereby should be deemed to extend to the subject matter claimed and all equivalents thereof fairly within the scope of the invention.

What is claimed is:

1. A method of producing a weld between two sheets comprising aluminum, comprising the steps of:

(A) pressing the sheets into contact wit each other;

(B) producing a molten weld nugget at a spot between the contacting sheets, comprising placing the sheets between a pair of electrodes and passing electrical current through the sheets; and, (C) promoting the formation of an equiaxed grain structure within the weld nugget by introducing particles into the molten nugget on which the equiaxed grain may grow as the nugget cools and solidifies.

2. The method of claim 1, wherein the particles comprise Ti.

3. The method of claim 1, wherein the particles comprise at least one material selected from the group consisting of:

(a) Al+Ti, (b) Al+Ti+C, (c) Ti–B alloy, (d) Na, (e) Al+Ti–B alloy, (f) Al–Ti–B–Re alloy or (g) K–Ti–C alloy.

4. The method of claim 1, wherein the particles comprise Na.

5. The method of claim 1, wherein step (C) is performed by introducing a powder comprising the particles between the sheets in the area of the spot.

6. The method of claim 1, wherein step (C) is performed by introducing a film of material comprising the particles between the sheets.

7. The method of claim 1, comprising applying a paste comprising the particles to at least one of the sheets in the area of the spot before step (A) is performed.

8. The method of claim 1, comprising introducing a film of material comprising the particles between the sheets before step (A) is performed.

9. A process as set forth in claim 1 wherein the particles comprise Ti and B.

10. A process as set forth in claim 1 wherein the particles comprise Ti and C.

11. A process as set forth in claim 1 wherein the particles comprise Ti and Re.

12. A method of producing a fusion bond between two workpieces comprising aluminum, comprising the steps of:

(A) bringing areas of the workpieces into contact with each other;

(B) melting a spot on the contacting workpiece areas comprising placing the workpieces between a pair of electrodes and passing electrical current through the two workpieces; and, (C) promoting the growth of equiaxed grain structure within the molten spot as the molten spot cools and solidifies, the growth promotion being performed by introducing a substance into the molten spot, the substance comprising at least one selected from the group consisting of:

(a) Al+Ti, (b) Al+Ti+C, (c) Ti–B alloy, (d) Na, (e) Al+Ti–B alloy, (f) Al–Ti–B–Re alloy, or (g) Al–Ti–C alloy.

13. The method as set forth in claim 12, wherein step (C) is performed by introducing a film comprising the substance between the workpieces comprising aluminum.

14. The method of claim 12, wherein step (C) is performed by applying a paste comprising the substance to one of the workpieces.

15. The method of claim 12, wherein step (C) is performed by introducing a powder comprising the substance between the workpieces.

16. A process as set forth in claim 12 wherein the substance comprises Ti and B.

17. A process as set forth in claim 12 wherein the substance comprises Ti and C.

18. A process as set forth in claim 12 wherein the substance comprises Ti and Re.

* * * * *